US011181858B1

(12) United States Patent
Okamura et al.

(10) Patent No.: US 11,181,858 B1
(45) Date of Patent: Nov. 23, 2021

(54) IMAGE FORMING APPARATUS AND DETECTING METHOD OF IMAGE DENSITY FAILURE

(71) Applicant: Konica Minolta, Inc., Tokyo (JP)

(72) Inventors: Kei Okamura, Yokohama (JP); Tomohiro Kawasaki, Sagamihara (JP); Kazutoshi Kobayashi, Toyokawa (JP); Keiki Katsumata, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/327,534

(22) Filed: May 21, 2021

(30) Foreign Application Priority Data

Jun. 10, 2020 (JP) ..... JP2020-100565

(51) Int. Cl.
*G03G 15/00* (2006.01)

(52) U.S. Cl.
CPC ..... *G03G 15/5025* (2013.01)

(58) Field of Classification Search
CPC ..... G03G 15/5025
See application file for complete search history.

(56) References Cited

U.S. PATENT DOCUMENTS 7,911,652 B2 * 3/2011 Goodman ..... G03G 15/5062 358/3.26
2013/0022365 A1 * 1/2013 Fujishima ..... G03G 15/0806 399/55
2018/0150010 A1 * 5/2018 Sone ..... G03G 15/1655

FOREIGN PATENT DOCUMENTS

JP 2006091597 A * 4/2006
JP 2009210810 A * 9/2009
JP 2018-063364 A 4/2018

* cited by examiner

*Primary Examiner* — Susan S Lee
(74) *Attorney, Agent, or Firm* — Squire Patton Boggs (US) LLP

(57) ABSTRACT

An image forming apparatus includes: a developer carrier; a screw-shaped developer feeder that feeds developer to the developer carrier; an image carrier on which an image is imaged with toner of the developer; a developing current detector that detects developing current between the image carrier and the developer carrier during imaging; and a controller that detects image density failure that is periodic and oblique to a rotation direction of the image carrier. The controller causes a stripe image to be imaged on the image carrier and analyzes change of the developing current with time during imaging of the stripe image, thereby detecting the image density failure. The stripe image has a width in a length direction of the image carrier narrower than a period of a blade of the developer feeder and has a length in the rotation direction longer than a period of the image density failure.

9 Claims, 9 Drawing Sheets

IMAGE FORMING APPARATUS AND DETECTING METHOD OF IMAGE DENSITY FAILURE

CROSS-REFERENCE TO RELATED APPLICATIONS

The entire disclosure of Japanese Patent Application No. 2020-100565 filed on Jun. 10, 2020 is incorporated herein by reference in its entirety.

BACKGROUND

Technological Field

The present invention relates to an image forming apparatus and a detecting method of image density failure.

Description of Related Art

In a conventional electrophotographic image forming apparatus, periodic image density failure in an image may occur in a direction oblique to a sheet feeding direction. The image density failure is caused due to unevenly fed developer from a feeding screw of a developing apparatus to a developing roller, and is called screw unevenness. Minor screw unevenness can be repaired by adjustment of imaging conditions (developing conditions). The screw unevenness can be detected using a known image analysis mechanism, however, not all imaging devices are equipped with such a mechanism because it is a costly option.

As a technology for detecting image failure in an image forming apparatus, for example, JP 2018-063364 A discloses an image forming apparatus that includes a developing current detector that detects an actually measured developing current that flows between an image carrier and a developer carrier, compares the actually measured developing current with an estimated developing current calculated based on an image forming condition, and determines whether or not image failure has occurred.

However, because the developing current is uniform when an image has a width more than a screw pitch, a period of screw unevenness in the width direction (see FIG. 5), screw unevenness cannot be always detected from an image printed by a user.

The object of the present invention is to detect the screw unevenness in an electrophotographic image forming apparatus without installing an image analysis mechanism.

SUMMARY

To achieve at least one of the above-mentioned objects, an image forming apparatus reflecting one aspect of the present invention includes:

a developer carrier that carries developer;

a screw-shaped developer feeder that feeds developer to the developer carrier;

an image carrier on which an image is imaged with toner of the developer that is fed from the developer carrier;

a developing current detector that detects a value of developing current that flows between the image carrier and the developer carrier during imaging; and a controller that detects image density failure that is periodic and oblique to a rotation direction of the image carrier, wherein the controller causes a stripe image to be imaged on the image carrier and analyzes change of the developing current with time detected by the developing current detector during imaging of the stripe image, thereby detecting the image density failure, the stripe image having a width in a length direction of the image carrier that is narrower than a period of a blade of the developer feeder and having a length in a rotation direction of the image carrier that is longer than a period of the image density failure.

To achieve at least one of the abovementioned objects, according to an aspect of the present invention, a detection method of image density failure performed in an image forming apparatus that includes a developer carrier that carries developer; a screw-shaped developer feeder that feeds developer to the developer carrier; an image carrier on which an image is imaged with toner of the developer that is fed from the developer carrier; and a developing current detector that detects a value of developing current that flows between the image carrier and the developer carrier during imaging, the image density failure being periodic and oblique to a rotation direction of the image carrier, the detection method including:

imaging a stripe image on the image carrier, the stripe image having a width in a length direction of the image carrier that is narrower than a period of a blade of the developer feeder and having a length in a rotation direction of the image carrier that is longer than the period of the image density failure, and analyzing change of the developing current with time detected by the developing current detector during imaging of the stripe image, thereby detecting the image density failure.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein.

DETAILED DESCRIPTION OF THE EMBODIMENTS

Hereinafter, one or more embodiments of the present invention will be described with reference to the drawings. However, the scope of the invention is not limited to the illustrated examples.

(Configuration of Image Forming Apparatus 1)

Figure 1:
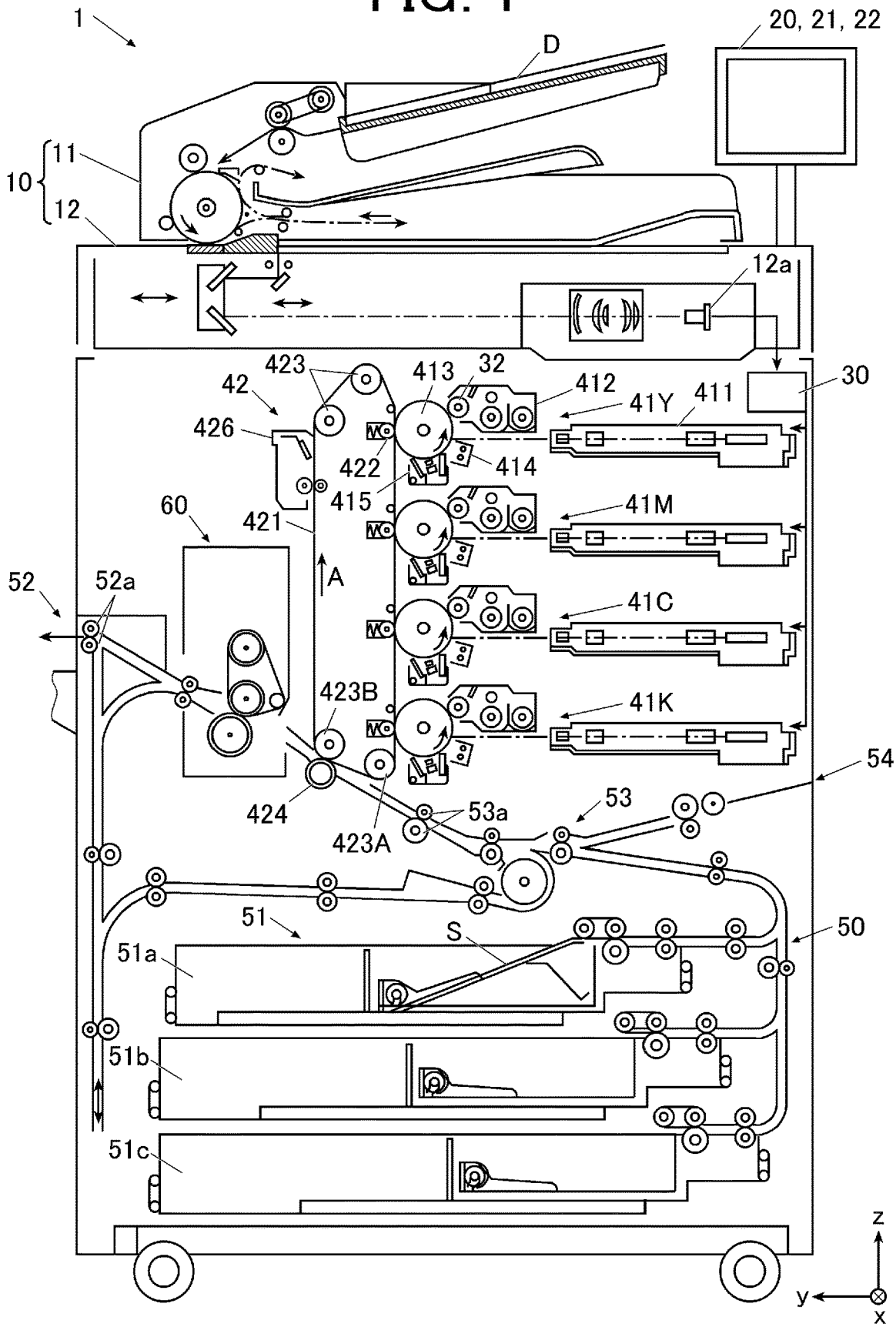
FIG. 1 shows a schematic diagram of an image forming apparatus.
Figure 2:
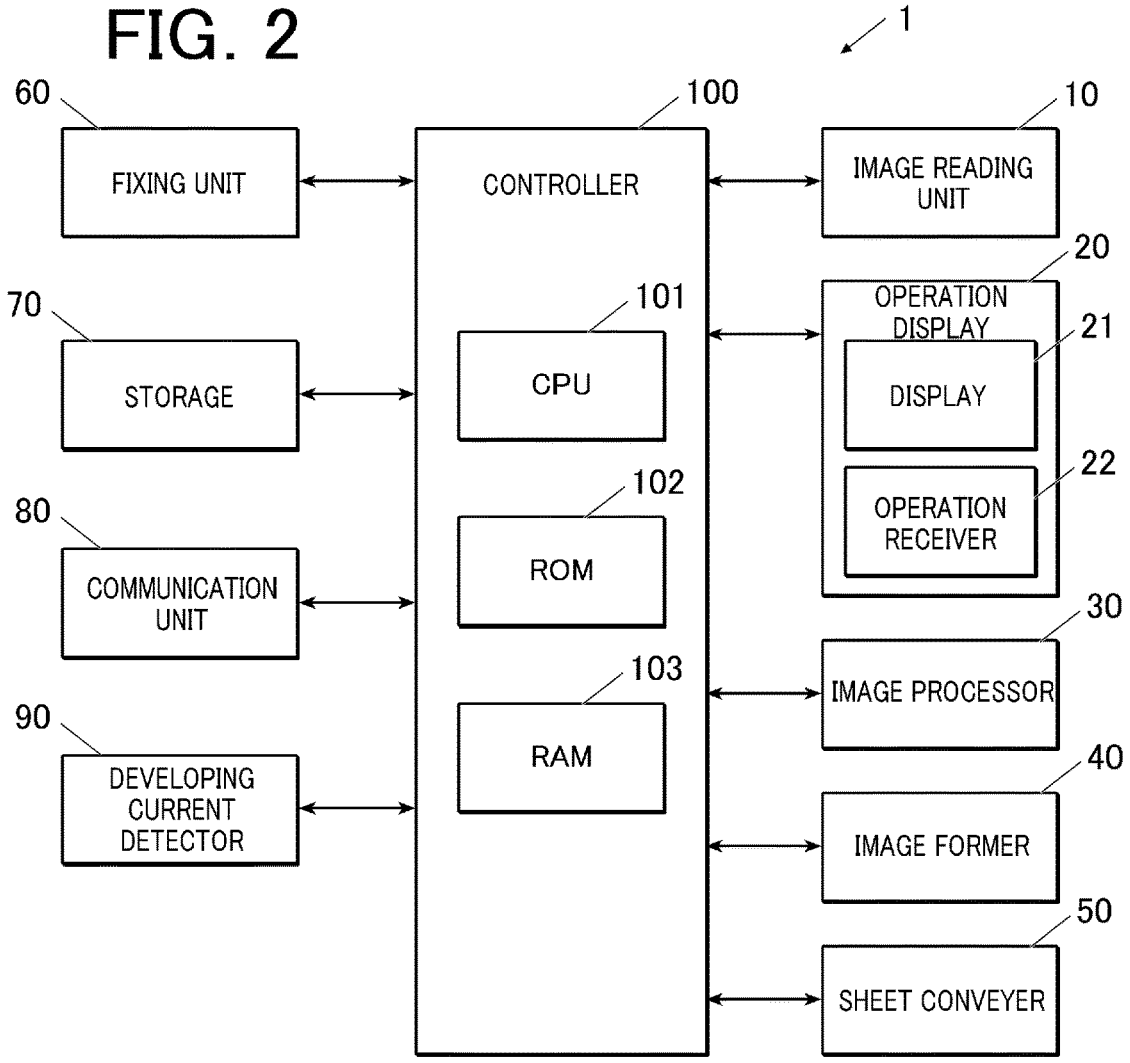
FIG. 2 shows a block diagram of a main functional structure of the image forming apparatus.

FIG. 1 shows a schematic diagram of an overall configuration of an image forming apparatus 1 according to the present invention. FIG. 2 is a block diagram showing a main functional configuration of the image forming apparatus 1 according to the first embodiment. The image forming apparatus 1 shown in FIG. 1 and FIG. 2 is a color image forming apparatus that utilizes electrophotographic process technology. In other words, the image forming apparatus 1 transfers color toner images of Y (yellow), M (magenta), C (cyan), and K (black) formed on respective photoconductor drums 413 to an intermediate transfer belt 421 (primary transfer) so as to overlay the toner images of the four colors on the intermediate transfer belt 421, and then transfers the overlaid images to the sheet S (secondary transfer) so as to form an image.

The image forming apparatus 1 employs a tandem system in which the photoconductor drums 413 each corresponding to each of the four colors (Y, M, C, and K) are arranged in series along a running direction of the intermediate transfer belt 421, and the respective color toner images are sequentially transferred to the intermediate transfer belt 421.

As shown in FIG. 2, the image forming apparatus 1 includes an image reading unit 10, an operation display 20, an image processor 30, an image former 40, a sheet conveyer 50, a fixing unit 60, a storage 70, a communication unit 80, a developing current detector 90, and a controller 100.

The controller 100 includes a CPU (Central Processing Unit) 101, ROM (Read Only Memory) 102, RAM (Random Access Memory) 103, and the like. The CPU 101 reads a program from the ROM 102 depending on the processing contents, loads the read program in the RAM 103, and centrally controls the operation of respective units of the image forming apparatus 1 shown in FIG. 2 in cooperation with the loaded program.

Figure 6:
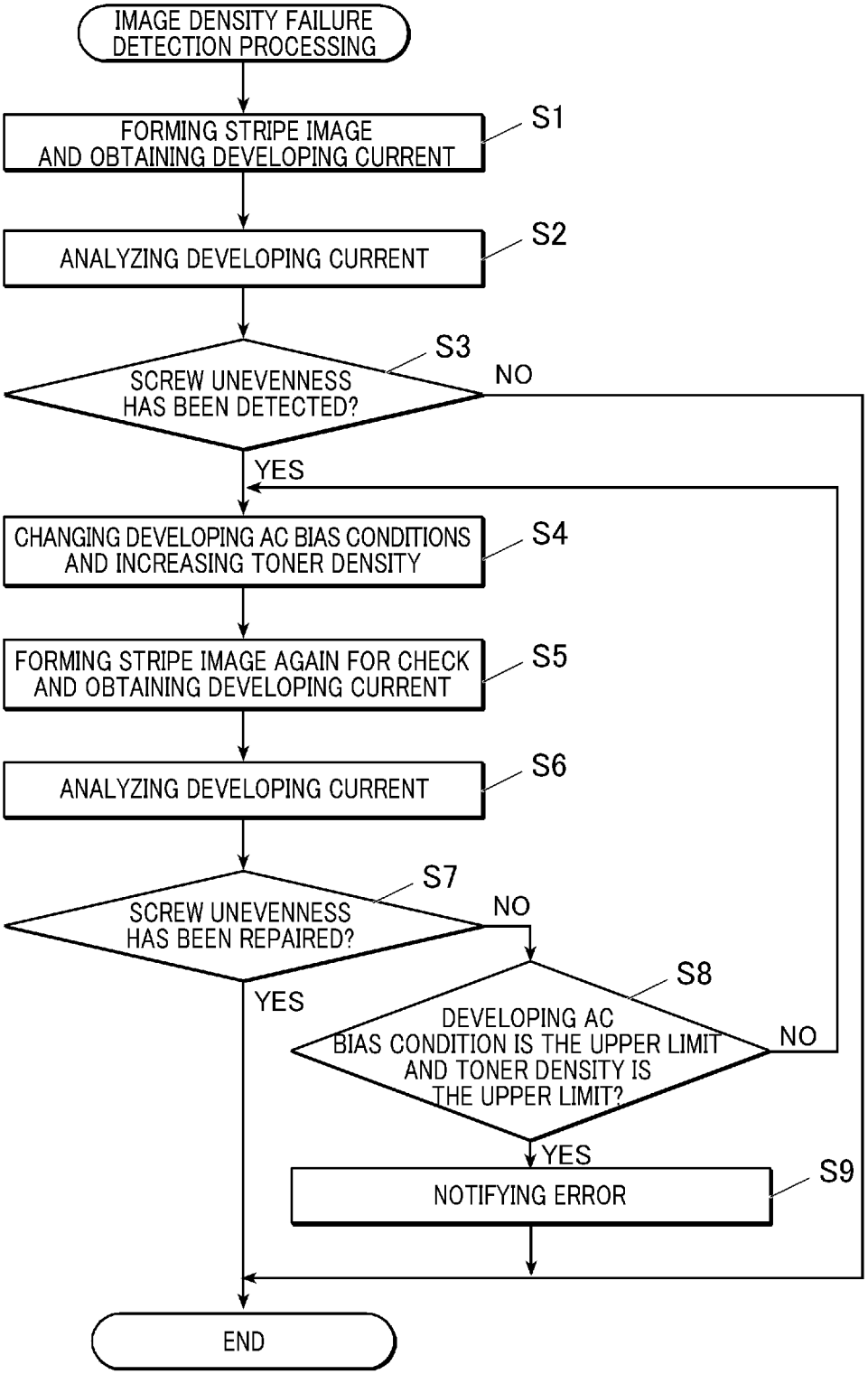
FIG. 6 is a flowchart showing image density failure detection processing performed by the controller in FIG. 2.

For example, the CPU 101 of the controller 100 executes image density failure detection processing shown in FIG. 6 in cooperation with the program stored in the ROM 102.

The image reading unit 10 includes an automatic document feeding device 11 called ADF (Auto Document Feeder), a document image scanning device 12 (scanner) and the like.

The automatic document feeding device 11 conveys a document D placed on a document tray using a conveyance mechanism and sends it to the document image scanning device 12. The automatic document feeding device 11 can read images on a large number of documents D (even on both sides of the documents) placed on the document tray in a continuous manner.

The document image scanning device 12 optically scans a document that is conveyed from the automatic document feeding device 11 or put onto the contact glass, forms an image of reflected light from the document on a light receiving surface of a CCD (Charge Coupled Device) sensor 12*a*, and reads an image on the document. Based on a reading result by the document image scanning device 12, the image reading unit 10 generates input image data. The image processor 30 performs predetermined image processing of the input image data.

The operation display 20 is a liquid crystal display (LCD) with a touch panel, for example, and functions as a display 21 and an operation receiver 22. The display 21 displays various operation screens, image status displays, operation status of each function, and the like according to display control signals input from the controller 100. The operation receiver 22 includes various operation keys such as a numeric keypad and a start key, accepts various input operations by the user, and outputs operation signals to the controller.

The image processor 30 has a circuit or the like that performs digital image processes on the input image data according to an initial setting or a user setting. For example, the image processor 30 performs tone correction based on tone correction data (tone correction table) under the control of the controller 100. In addition to the tone correction, the image processor 30 performs various correction processes such as color correction and shading correction, as well as a compression process, on the image data. The image data that has undergone these processes is input to the image former 40.

The image former 40 includes image forming units 41Y, 41M, 41C, and 41K, an intermediate transfer unit 42, and the like to form images with color toners of Y, M, C, and K components based on the input image data.

The image forming units 41Y, 41M, 41C, and 41K respectively for the Y, M, C, and K components have similar configurations. For convenience of illustration and description, common components are indicated with the same numeral, the sign Y, M, C, or K is added to the numeral when it is necessary to distinguish the colors. In FIG. 1, signs are added to the numbers only for the components of the image forming unit 41Y for the Y component, and are omitted for the components of the other image forming units 41M, 41C, and 41K.

The image forming unit 41 includes an exposing device 411, a developing device 412, a photoconductor drum (an "image carrier" of the present invention) 413, a charging device 414, a drum cleaning device 415, and the like. The length direction of each device (including the photoconductor drum 413) that constitutes the image forming unit 41 is the x direction in FIG. 1.

The photoconductor drum 413 is a negatively charged Organic Photo-conductor (OPC) with an under coat layer (UCL), a charge generation layer (CGL), and a charge transport layer (CTL) laminated in this order on a circumference of a conductive cylindrical body made of aluminum (aluminum bare tube) having a drum diameter of 80 mm, for example.

The controller 100 controls driving current fed to a driving motor (not shown) that rotates the photoconductor drum 413, such that the photoconductor drum 413 rotates at a constant circumferential speed in the arrow direction in FIG. 1.

The charging device 414 uniformly charges the photoconductive surface of the photoconductor drum 413 to have a negative polarity.

The exposing device 411 includes a semiconductor laser, for example, and irradiates the photoconductor drum 413 with laser light corresponding to the image of each color component. Positive charge is generated in the charge generation layer of the photoconductor drum 413 and transported to the surface of the charge transport layer, thereby neutralizing the surface charge (negative charge) of the photoconductor drum 413. An electrostatic latent image of each color component is formed on the surface of the photoconductor drum 413 due to the potential different from that of the surrounding region.

The developing device 412 is a developing device of a two-component developing method, and visualizes the electrostatic latent image by attaching toner of each color component to the surface of the photoconductor drum to form (to image) a toner image. In other words, the developing roller 32 (the "developer carrier" of the present invention) of the developing device 412 carries the developer while rotating, and forms a toner image on the surface of the photoconductor drum 413 by feeding the toner contained in the developer to the photoconductor drum 413. Details of the developing device 412 will be described later.

The drum cleaning device 415 has a drum cleaning blade and the like that is in sliding contact with the surface of the photoconductor drum 413 and removes residual toner remaining on the surface of the photoconductor drum 413 after the primary transfer.

The intermediate transfer unit 42 includes an intermediate transfer belt 421, a primary transfer roller(s) 422, a plurality of support rollers 423, a secondary transfer roller 424, a belt cleaning device 426, and the like.

The intermediate transfer belt 421 is composed of an endless belt that is a loop stretched over the support rollers 423. At least one of the support rollers 423 is a driving roller, and the other(s) is a driven roller(s). For example, it is preferable that a roller 423A that is arranged downstream in the belt running direction from the primary transfer roller 422 of the K component is the driving roller. This makes it is easy to maintain a constant running speed of the belt in primary transfer. As the driving roller 423A rotates, the intermediate transfer belt 421 runs at a constant speed in the direction of the arrow A.

The primary transfer roller(s) 422 is arranged on the inner peripheral surface of the intermediate transfer belt 421 so as to face the photoconductor drum(s) 413 of the respective color component(s). The primary transfer roller 422 is pressed against the corresponding photoconductor drum 413 across the intermediate transfer belt 421, such that a primary transfer nip is formed where the toner image on the photoconductor drum 413 is transferred to the intermediate transfer belt 421.

The secondary transfer roller 424 is arranged on the outer peripheral surface of the intermediate transfer belt 421 so as to face a roller 423B that is arranged on the downstream side in the belt running direction of the drive roller 423A. The secondary transfer roller 424 is pressed against the roller 423B across the intermediate transfer belt 421, such that a secondary transfer nip is formed for transferring the toner image on the intermediate transfer belt 421 to the sheet S.

When the intermediate transfer belt 421 passes through the primary transfer nip, toner images on the photoconductor drums 413 are sequentially overlaid on the intermediate transfer belt 421 in the primary transfer. Specifically, the toner images are electrostatically transferred to the intermediate transfer belt 421 by applying a primary transfer bias to the primary transfer rollers 422 and applying a charge of opposite polarity to the toner on the back side of the intermediate transfer belt 421 (the side in contact with the primary transfer rollers 422).

Thereafter, when the sheet S passes through the secondary transfer nip, the toner images on the intermediate transfer belt 421 are transferred to the sheet S (secondary transfer). Specifically, a secondary transfer bias is applied to the secondary transfer roller 424, and a charge of opposite polarity to that of the toner is applied to the back side of the sheet S (the side in contact with the secondary transfer roller 424), so that the toner images are electrostatically transferred to the sheet S. The sheet S on which the toner images have been transferred is conveyed toward the fixing unit 60.

The belt cleaning device 426 has a belt cleaning blade and the like that is in sliding contact with the surface of the intermediate transfer belt 421 and removes residual toner remaining on the surface of the intermediate transfer belt 421 after the secondary transfer. Instead of the secondary transfer roller 424, a so-called belt-type secondary transfer unit in which a secondary transfer belt that is a loop stretched over a plurality of support rollers including a secondary transfer roller may be used.

The fixing unit 60 heats and pressurizes the conveyed sheet S on which the toner images have been transferred at a fixing nip to fix the toner images on the sheet S.

The sheet conveyer 50 includes a sheet feeding unit 51, a sheet discharge unit 52, and a conveying path 53. Three sheet tray units 51*a*-51*c* of the sheet feeding section 51 each accommodate sheets S (standard sheets and special sheets) of respective basis weight and size according to the predetermined settings. The conveying path 53 has a plurality of conveying roller pairs, such as a resist roller pair 53*a*.

The sheets S stored in the sheet tray units 51*a* to 51*c* are sent out one by one from the top and conveyed to the image former 40 through the conveying path 53. At this time, a resist roller section including the resist roller pair 53*a* corrects inclination of the fed sheet S and adjusts the conveying timing. Then, in the image former 40, the toner images on the intermediate transfer belt 421 are transferred (secondary transfer) to one surface of the sheet S together, and the fixing unit 60 performs a fixing process. The sheet S on which an image is formed is discharged from the machine through the sheet discharge unit 52 having sheet discharge rollers 52*a*.

The sheet S may be a long sheet of paper or a roll of paper. Such a sheet S is stored in a sheet feeding device (not shown) that is connected to the image forming apparatus 1. The sheet S held in the sheet feeding device is fed from the sheet feeding device to the image forming apparatus 1 through a sheet feeding port 54, so as to be sent out to the conveying path 53.

The storage 70 includes, for example, a non-volatile semiconductor memory (so-called flash memory), a hard disk drive, or the like. The storage 70 stores various kinds of data such as various kinds of setting information for the image forming apparatus 1.

The communication unit 80 includes a communication control card such as a LAN (Local Area Network) card, and sends and receives various kinds of data to and from an external apparatus (for example, a personal computer) connected to a communication network such as a LAN or WAN (Wide Area Network).

The developing current detector 90 is located in each of the image forming units 41 and detects the developing current that flows between the photoconductor drum 413 and the developing roller 32 when toner images are imaged on the photoconductor drum 413. The developing current detector 90 detects the value of the developing current due to the developing bias applied to the developing roller 32 by the developing bias application unit (not shown in the drawing) and outputs it to the controller 100.

(Configuration of Developing Device 412)

The structure of the developing device 412 will be described in detail below.

Figure 3:
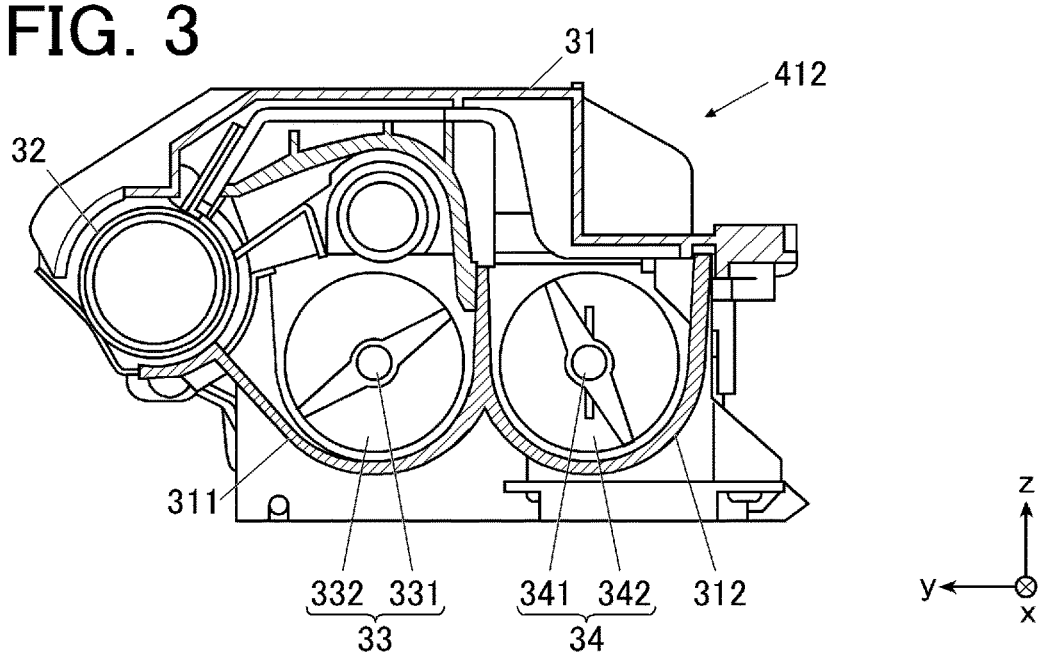
FIG. 3 shows a vertical cross-section of a developing device.
Figure 4:
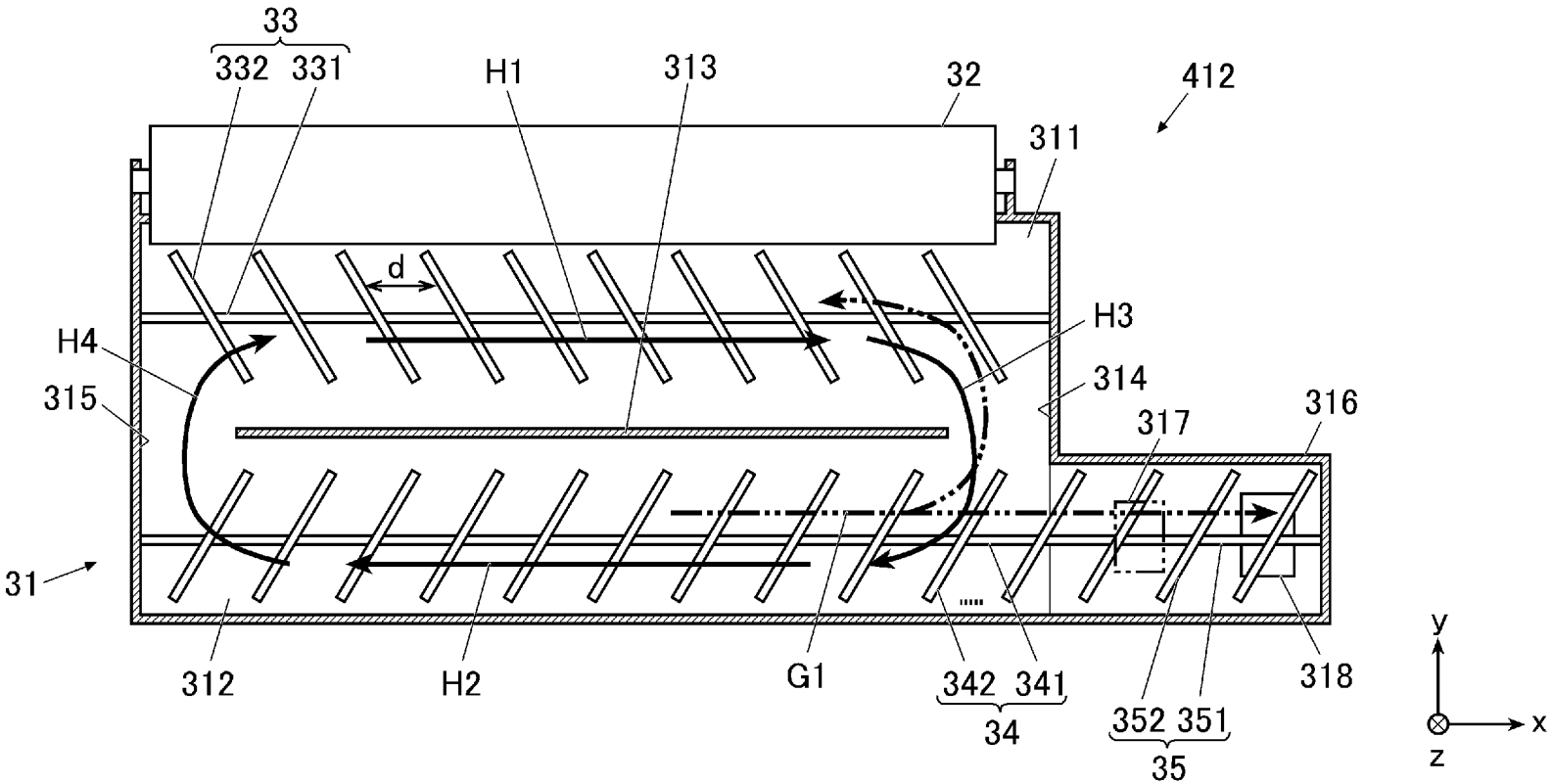
FIG. 4 shows a horizontal cross-section of the developing device viewed from above.

FIG. 3 shows a vertical cross-section of the developing device 412, and FIG. 4 shows a horizontal cross-section of the developing device 412 viewed from above.

As shown in FIG. 3 and FIG. 4, the developing device 412 includes a housing 31 that houses the developer and supports the overall configuration of the developing device 412, a developing roller 32 as the developer carrier that feeds toner of the developer to the photoconductor drum 413, a feeding screw 33 as a developer feeder that feeds the developer to the developing roller 32, and an agitation screw 34 that conveys the developer in a direction opposite to the conveyance direction of the developer by the feeding screw 33.

The developer is a dry-type two-component developer including toner and carrier, and the toner can be charged when the toner and carrier are mixed and agitated. The charged toner adheres to the surface of the photoconductor drum 413 on which the electrostatic latent image is formed through the developing roller 32, and the toner image is developed.

The housing 31 has an opening that is open to the photoconductor drum 413, and the developing roller 32 is rotatably supported in the space formed near the opening.

Both the developing roller 32 and the photoconductor drum 413 are cylindrical, and their rotation shafts are parallel to each other and horizontally oriented. Furthermore, the developing roller 32 and the photoconductor drum 413 are arranged such that the outer circumferential surface of the developing roller 32 and the outer circumferential surface of the photoconductor drum 413 form a predetermined developing gap.

The housing 31 includes a feeding chamber 311 that houses the feeding screw 33 and an agitation chamber 312 that houses the agitation screw 34.

In the housing 31, the developing roller 32, the feeding screw 33, and the agitation screw 34 are arranged in a line almost in the y direction and are all supported so that their rotation shafts are parallel to the x direction. The feeding screw 33 and the feeding chamber 311 are arranged next to the developing roller 32, on the opposite side of the photoconductor drum 413. The agitation screw 34 and the agitation chamber 312 are arranged next to the feeding screw 33 and the feeding chamber 311, on the opposite side of the developing roller 32.

The developing roller 32, the feeding screw 33, and the agitation screw 34 are all operated in the same rotation direction as and in conjunction with each other through a power transmission mechanism using a motor not shown in the figure as the driving source.

The feeding screw 33 includes a first shaft 331 rotatably supported in the housing 31 and a helical (screw-like) agitation blade 332 fixed to the first shaft 331.

The cross section along the y-z plane of the inner bottom of the feeding chamber 311 has an arc shape that is convex toward the bottom, and its inner diameter is set to be slightly larger than the outermost diameter of the agitation blade 332. The agitation blade 332 is arranged such that its outer circumference is close to the inner bottom of the feeding chamber 311.

When the feeding screw 33 is driven in the specified (positive) rotational direction with the feeding chamber 311 filled with the developer, the developer can be conveyed, while being agitated, through the feeding chamber 311 in the direction indicated by the arrow H1 that is parallel to the x direction.

The feeding screw 33 is located close to the developing roller 32 for the entire length of the developing roller 32 in the x-direction, and can feed the toner included in the developer over the entire circumference of the developing roller 32.

The agitation screw 34 includes a second shaft 341 rotatably supported in the housing 31 and a helical agitation blade 342 fixed to the second shaft 341.

The cross section along the y-z plane of the inner bottom of the agitation chamber 312 has an arc shape that is convex toward the bottom, and its inner diameter is set to be slightly larger than the outermost diameter of the agitation blade 342. The agitation blade 342 is arranged such that its outer circumference is close to the inner bottom of the agitation chamber 312.

The agitation blade 342 of the agitation screw 34 is formed in a helical shape whose spiral direction is opposite to that of the agitation blade 332 of the feed screw 33.

When the agitation screw 34 is driven in the specified (positive) rotational direction with the agitation chamber 312 filled with the developer, the developer can be conveyed, while being agitated, through the agitation chamber 312 in the direction indicated by the arrow H2 (in the opposite direction to that indicated by the arrow H1) that is parallel to the x direction.

The feeding chamber 311 and the agitation chamber 312 are separated by a partition wall 313 parallel to the x-z plane, and the partition wall 313 has openings formed at one end and the other end in the x-direction through which the developer flows between the feeding chamber 311 and the agitation chamber 312.

The opening at the right end of the partition wall 313 in FIG. 4 is the first communication part 314 that passes the developer from the feeding screw 33 to the agitation screw 34. The opening at the left end of the partition wall 313 in FIG. 4 is the second communication part 315 that passes the developer from the the agitation screw 34 to feeding screw 33.

That is, because the feeding screw 33 conveys the developer in the direction of the arrow H1 as described above, the developer in the feeding chamber 311 is pushed in the direction of the arrow H3 toward the agitation chamber 312 through the first communication part 314, which is at the downstream end in the conveyance direction by the feeding screw 33 rotating in its positive rotational direction.

Similarly, because the agitation screw 34 conveys the developer in the direction of the arrow H2 as described above, the developer in the agitation chamber 312 is pushed in the direction of the arrow H4 toward the feeding chamber 311 through the second communication part 315, which is at the downstream end in the conveyance direction by the agitation screw 34 rotating in its positive rotational direction.

In other words, in the housing 31, the developer is conveyed along an annular circulation path connecting the arrows H1, H3, H2, and H4.

One end of the agitation screw 34 is connected to the supply screw 35. The supply screw 35 includes a third shaft 351 rotatably supported in the housing 31 and a helical agitation blade 352 fixed to the third shaft 351. The third shaft 351 is concentrically connected to and rotates together with the second shaft 341 of the agitation screw 34. The agitation blade 352 and the agitation blade 342 of the agitation screw 34 convey the developer in the same direction.

The supply screw 35 is housed in the supply chamber 316 provided on one side of the agitation chamber 312.

The supply chamber 316 has a cross-sectional shape along the y-z plane that is almost the same as that of the agitation chamber 312, and the supply chamber 316 is connected to the agitation chamber 312 without any boundary wall, step, or the like between them.

The supply chamber 316 has a developer supply outlet 317 to supply the developer into the housing 31/The developer supply outlet 317 is located close to the agitation chamber 312 at the wall around the supply screw 35 (for example, above the supply screw 35). In FIG. 4, the location of the developer supply outlet 317 is indicated by a rectangle surrounded by a double-dotted line.

Above the supply chamber 316, a supply unit (not shown) is arranged. The supply unit includes a supply toner storage section in which toner is stored and a conveyance mechanism that conveys the toner from the supply toner storage section. The toner is supplied to the supply screw 35 in the supply chamber 316 from above through the developer supply outlet 317.

As a result, the supplied toner is conveyed in the same direction as the arrow H2, joins the developer circulating in the aforementioned annular circulation path in the housing 31, and is agitated by the agitation screw 34.

Toner is consumed during image forming using the dry-type two-component developer. Therefore, the controller 100 controls the conveyance mechanism of the supply unit to feed a specified amount of toner when a predetermined condition(s) is met.

In the supply chamber 316, the supply screw 35 is arranged over almost the entire length in the x direction. The supply chamber 316 has an agitation-chamber-side developer outlet 318 at the wall around the supply screw 35 at the upstream of the developer supply outlet 317 in the conveyance direction of the developer by the the supply screw 35 rotating in its positive rotational direction (the same conveyance direction as that by the agitation screw 34).

This agitation-chamber-side developer outlet 318 opens downward from the inner bottom portion of the supply chamber 316. The developer discharged from this agitation-chamber-side developer outlet 318 falls into a waste developer storage part (not shown) and stored.

(Operation of Image Forming Apparatus 1)

Next, the operation of the image forming apparatus 1 will be explained.

When the developer is fed from the feeding screw 33 to the developing roller 32 as described above, a decrease in bulk of the developer due to change in its physical property may result in uneven feeding of the developer, which in turn causes periodic density unevenness (image density failure causing low density) in a direction oblique to the rotation direction of the photoconductor drum 413 (drum rotation direction). This is called screw unevenness.

Figure 5:
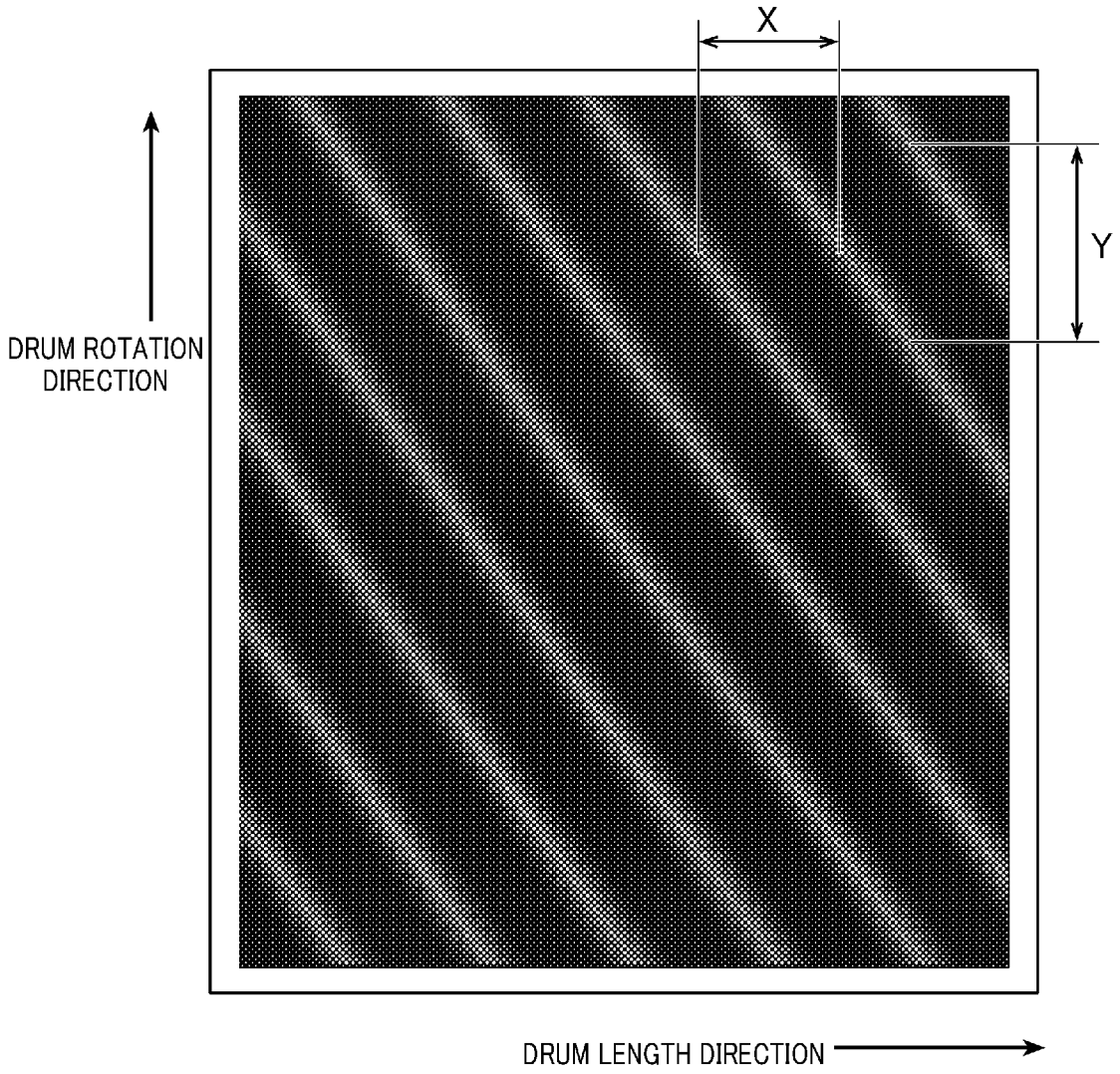
FIG. 5 shows an example of the screw unevenness.

FIG. 5 shows an example of the screw unevenness. A horizontal pitch X, which is the period of the screw unevenness in the length direction of the photoconductor drum 413 (drum length direction (horizontal direction)), corresponds to the period d of the agitation blade 332 of the supply screw 33. The vertical pitch Y, which is the period of the screw unevenness in the drum rotation direction (vertical direction), is determined by the following Equation 1.

$$Y = \frac{\text{(Rotation Speed of Developing Roller)}}{\left(\begin{array}{c}\text{Rotation Number of Supply Screw (rpm)} \times \\ \text{(Number of Turns of Supply Screw}\end{array}\right)} \times \frac{\text{(Rotation Speed of Drum)}}{\text{(Rotation Speed of Developing Roller)}} \qquad \text{Equation 1}$$

The screw unevenness results in a decrease in the quality of the printed material that is output by the image forming apparatus 1. Therefore, the controller 100 of the image forming apparatus 1 performs image density failure detection processing shown in FIG. 6 to detect and repair the above-mentioned screw unevenness based on developing current detected by the developing current detector 90.

The image density failure detection processing may be automatically executed when a predetermined condition is met (for example, when a predetermined number of sheets of paper have been printed, when a predetermined time has elapsed, when a predetermined environment has been created (for example, when a temperature (or humidity) in the apparatus exceeds a predetermined threshold), when the toner charge level falls below a predetermined threshold, or the like), or it may be executed in response to user's operation of the operation receiver 22.

In the image density detection processing shown in FIG. 6, the controller 100 first causes the developing current detector 90 to detect the developing current value while a stripe image for detecting screw unevenness is imaged on the photoconductor drum 413 of each of the image forming units 41Y, 41M, 41C, and 41K, and obtains the developing current at the time when the stripe image is formed (Step S1).

For example, the controller 100 causes the developing current detector 90 to detect the developing current each time when an image of one scanning line is formed on the photoconductor drum 413.

Figure 7:
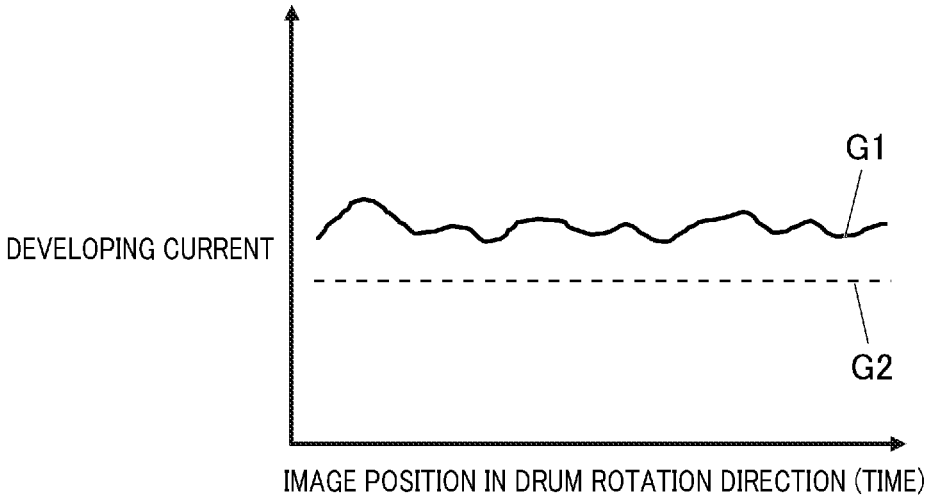
FIG. 7 is a graph showing change of developing current with time when imaging is performed on an entire surface of photoconductor drum.

The developing current is generated because of the movement of toner between the developing roller 32 and the photoconductor drum 413 during imaging. The developing current is proportional to the amount of moved toner and correlates with the average image density in the drum length direction. When there is a change in the average image density in the drum rotation direction, the developing current also changes correspondingly. For example, when an image with uniform overall density (tone value) is imaged with periodic horizontal band-shaped unevenness in the drum rotation direction (for example, density unevenness caused by wobbly developing roller 32), the developing current also changes periodically as shown by line G1 in FIG. 7. On the other hand, with the oblique unevenness such as screw unevenness, the ratio of the original density portion to the low density portion (unevenness) in the drum longitudinal direction is substantially uniform as shown in FIG. 5. As a result, the developing current for the position in the drum rotation direction is also uniform, and it is difficult to detect the screw unevenness.

Therefore, in step S1, one of the following stripe images (1) to (3) is imaged on the photoconductor drum 413. The stripe image is an image with a uniform tone value.

(1) A stripe image of a single vertical stripe (stripe image P1)

(2) Stripe images of a plurality of vertical stripes arranged in equal periods (stripe image group P2)

(3) Stripe images of a plurality of oblique stripes arranged in equal periods (stripe image group P3)

(1) Stripe Image P1

Figure 8A:
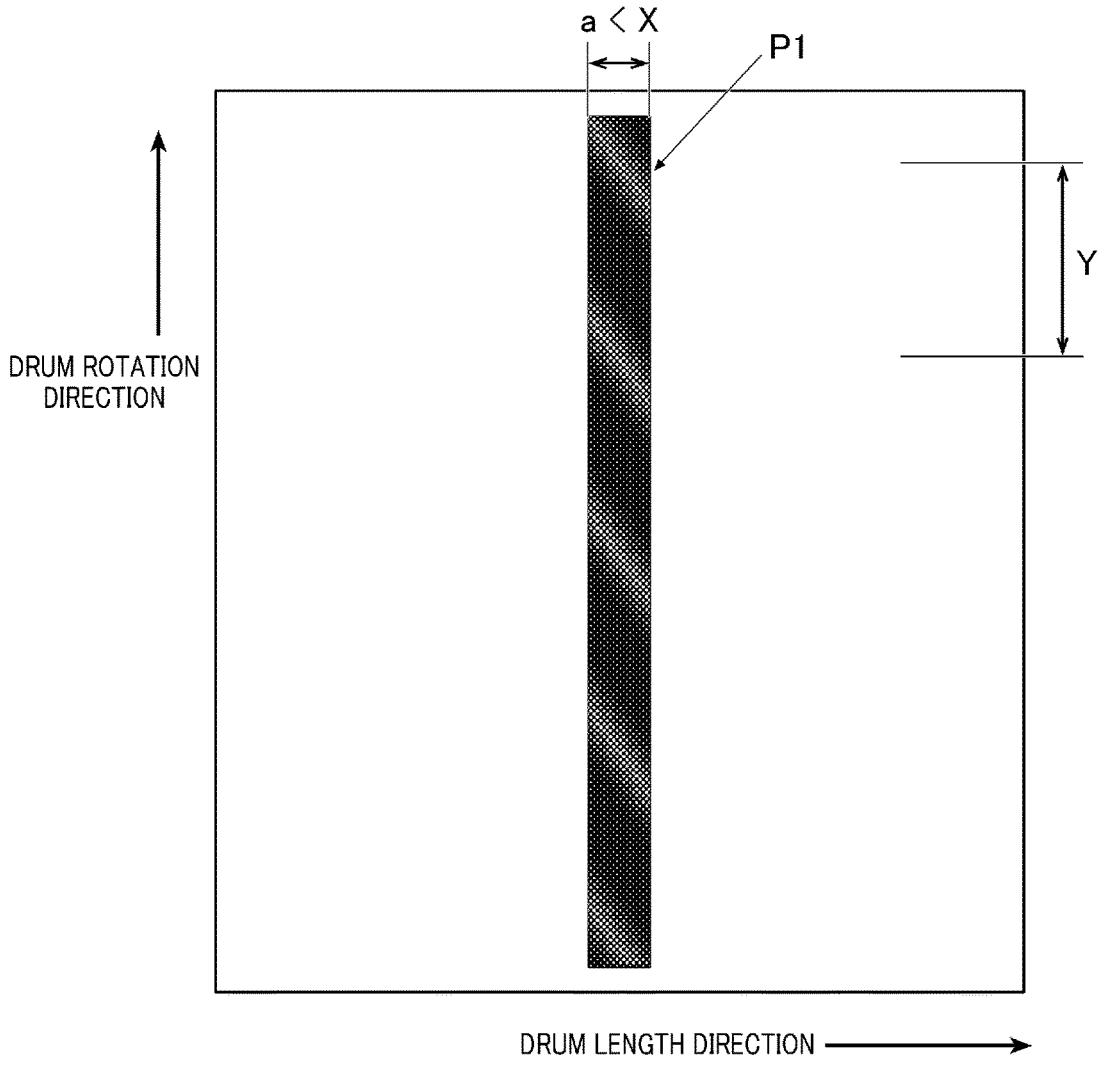
FIG. 8A shows an example of a stripe image.

FIG. 8A shows an example of the stripe image P1 when screw unevenness is occurring.

Figure 8B:
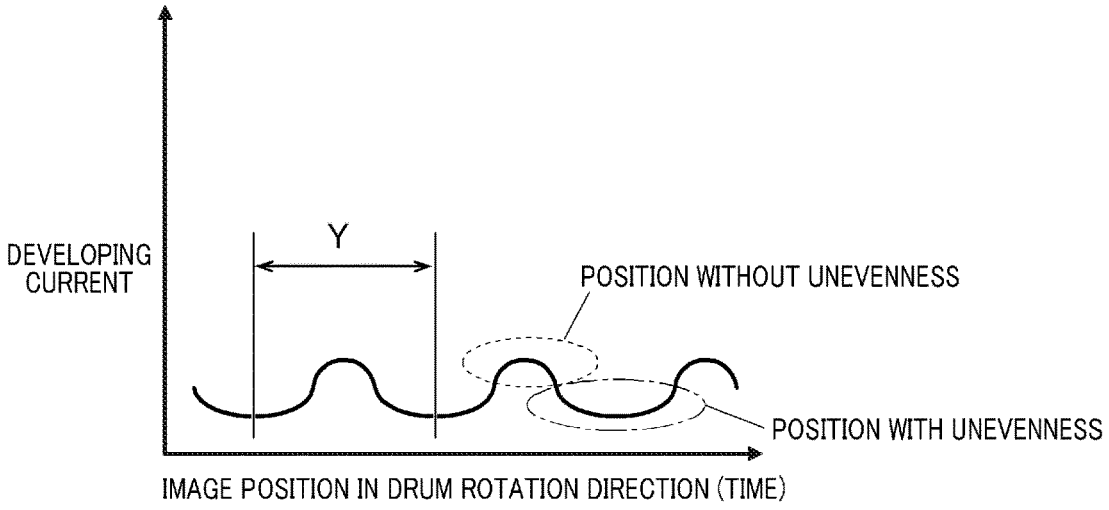
FIG. 8B is a graph showing change of developing current with time when imaging the stripe image shown in FIG. 8A.

The stripe image P1 is an image of a single vertical stripe having width (dimension in the drum length direction) "a" that is narrower than the horizontal pitch X described above (that is, the period "d" of the agitation blade 332 of the feed screw) and having length (dimension in the drum rotation direction) that is longer than the vertical pitch Y described above. Since the width of the stripe image P1 to be imaged is narrower than the horizontal pitch X, when screw unevenness is occurring as shown in FIG. 8A, the stripe can be divided into positions with and without screw unevenness (low density area) in the drum rotation direction. Furthermore, when screw unevenness is occurring, the developing current obtained during imaging of the stripe image P1 changes with a period of vertical pitch Y as the waveform in the graph in FIG. 8B. When the width a of the stripe image P1 is equal to or more than the horizontal pitch X, there is no portion without unevenness, and the obtained developing current does not change periodically as shown in the graph mentioned above.

(2) Stripe Image Group P2

Figure 9A:
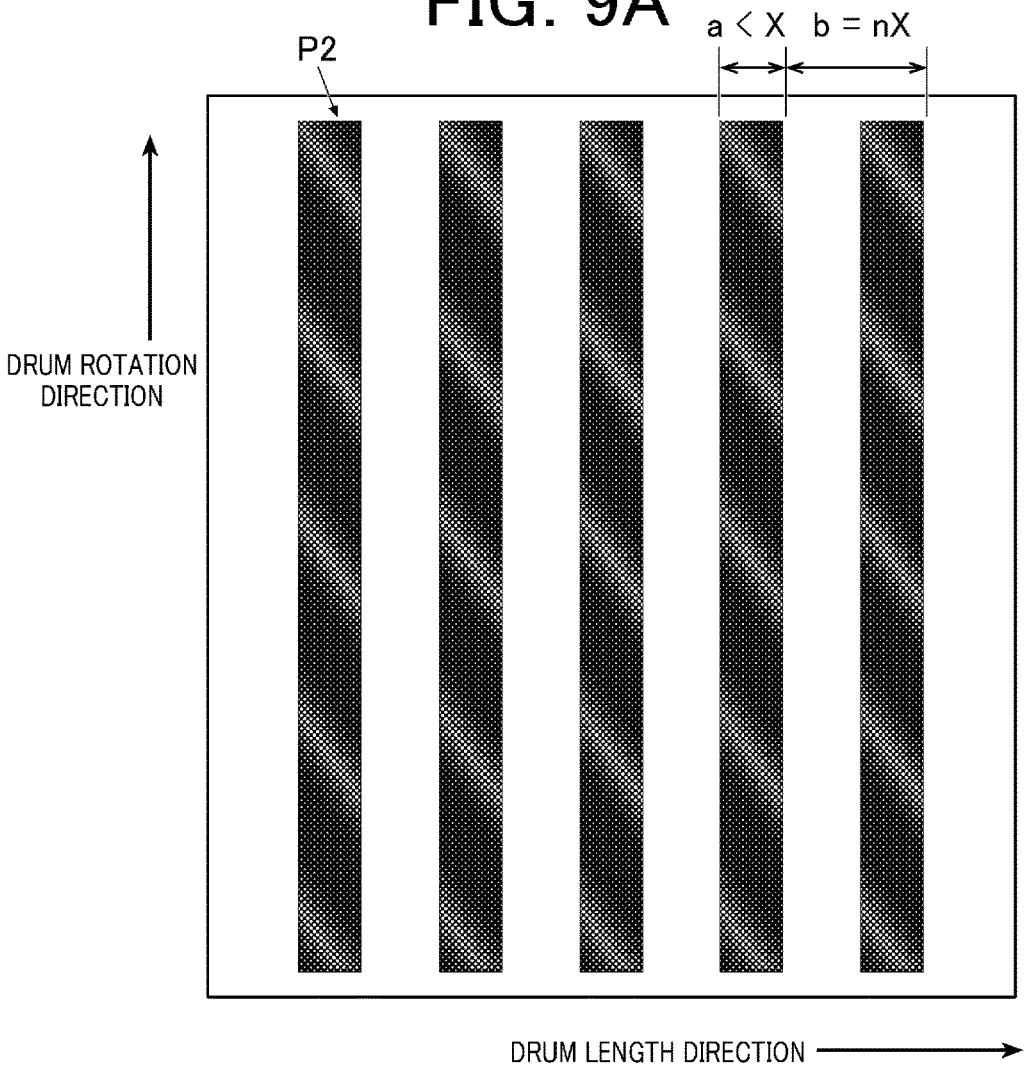
FIG. 9A shows an example of a stripe image group including a plurality of vertical stripe images.

FIG. 9A shows an example of the stripe image group P2 when screw unevenness is occurring.

Figure 9B:
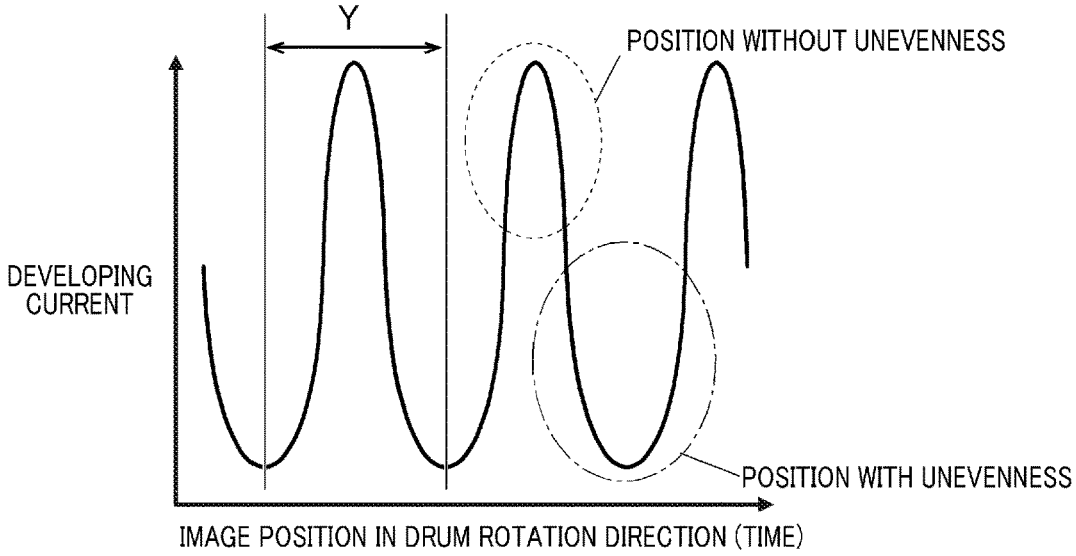
FIG. 9B is a graph showing change of developing current with time when imaging the stripe image group shown in FIG. 9A.

When there is only one stripe as in the stripe image P1 described above, the detected developing current is weak and it may be difficult to analyze the period (cycle) from its waveform. In contrast, the stripe image group P2 imaged on the photoconductor drum 413 includes a plurality of vertical stripe images (each of the stripe images is the same as the stripe image P1) arranged at a period "b" that is equal to or an integral multiple of the horizontal pitch X (b=nX, where n is an integer greater than or equal to one). According to the stripe image group P2, the developing current detected at the portion without uneveness can be increased compared to that of the stripe image P1 of above (1). When screw unevenness occurs, as shown in FIG. 9B, it is possible to clearly distinguish between developing currents at positions with and without unevenness, and to easily analyze the period (cycle) of developing current. If the period b at which the stripe images are arranged is not a multiple of the horizontal pitch X, the analysis becomes difficult because there may be no portions without unevenness, or the unevenness appears at two or more phases in a period.

(3) Stripe Image Group P3

Figure 10:
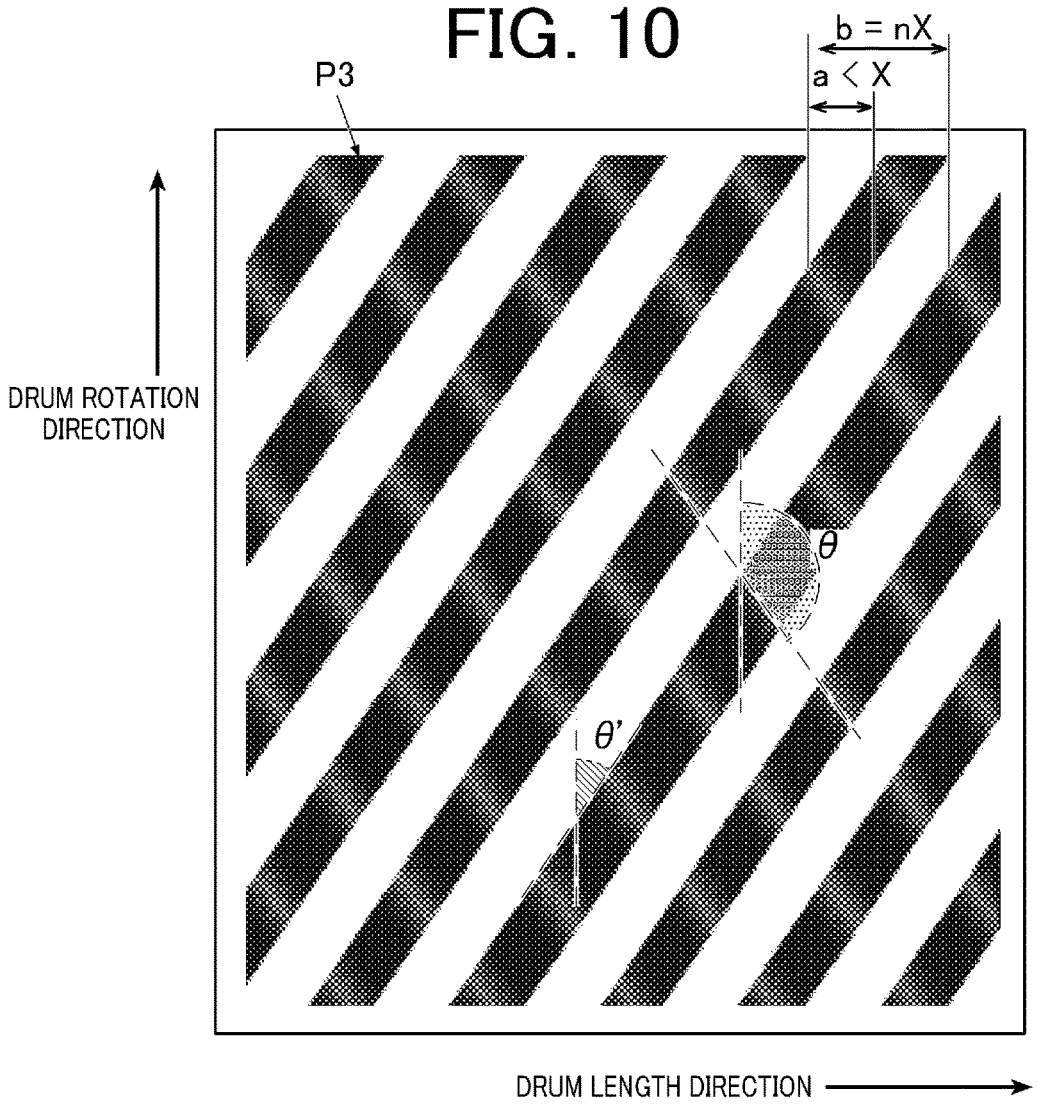
FIG. 10 shows an example of a stripe image group including a plurality of oblique stripe images.

FIG. 10 shows an example of the stripe image group P3 when screw unevenness is occurring.

The stripe image group P3 includes a plurality of oblique stripe images that satisfy the following conditions are arranged in equal periods.

- Each of the stripe images has long sides that are not parallel to the screw unevenness (but cross the screw unevenness).
- Each of the stripe images is not orthogonal to the drum rotation direction.
- The width (width in the drum longitudinal direction) "a" of each of the stripe images is narrower than the horizontal pitch X described above, and the length (length in the drum rotation direction) of each of the stripe images is longer than the vertical pitch Y described above.

The range of the angle θ' that the long side of each of the oblique stripe images can take with respect to the drum rotation direction satisfies the followings.

$0° \leq \theta' < 90°$ $90° < \theta' < \theta$ $\theta \leq \theta' < 180°$

In the inequalities, θ is an angle of screw unevenness (angle of thread-like line in the screw unevenness) with respect to the drum rotation direction, and can be calculated by $\theta = 180 - \arctan(X/Y)$.

The oblique stripe images are arranged at a period b equal to or an integral multiple of the horizontal pitch X (b=nX, where n is an integer greater than or equal to one).

According to the stripe image group P3, the developing current detected at the portion without uneveness can be also increased compared to that of the stripe image P1 of above (1). When screw unevenness occurs, as shown in FIG. 9B, it is possible to clearly distinguish between developing currents at positions with and without unevenness, and to oblique stripe that satisfies the above conditions may be used as the stripe image for detecting screw unevenness.

Next, the controller 100 analyzes change of the obtained developing current with time (Step S2), and determines whether or not screw unevenness has been detected (Step S3).

Figure 11:
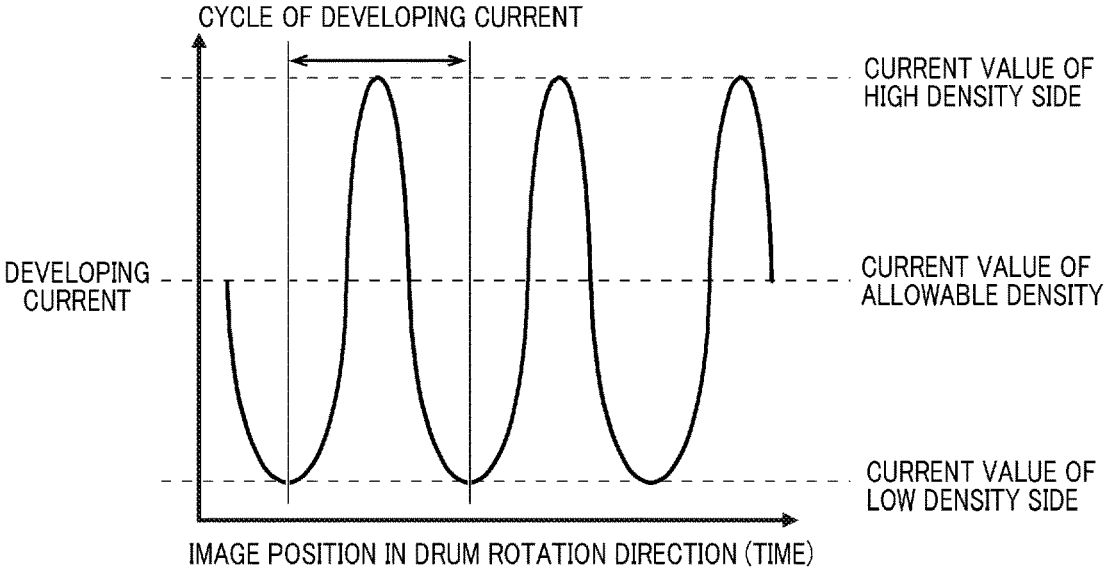
FIG. 11 is a diagram to illustrate a detection criterion for detecting screw unevenness.

In step S3, the controller 100 arranges the obtained developing currents in time series order, generates a graph showing change of the developing current with time (change in developing current according to the position in the drum rotation direction) as shown in FIG. 11, and determines that screw unevenness has been detected when the obtained developing current changes with time satisfying the following conditions.

(Current Value of Low Density Side)<(Current Value of Allowable Density)

The developing current has periodicity.

(Period of Developing Current)=(Vertical Pitch *Y* of Screw Unevenness or its Integral Multiple)

The current value of the low density side is the developing current value at the screw unevenness portions (i.e., the minimum value of the graph showing change of the developing current with time at the time of imaging). The current value of the high density side is the developing current value at the solid portions with no unevenness (i.e., the maximum value of the graph showing change of the developing current with time at the time of imaging). The current value of allowable density is the developing current value that is used as a criterion for detecting screw unevenness, and corresponds to the density that is not visually recognized as unevenness (but allowable). The controller 100 sets the current value of allowable density to a value proportional to the current value of the high density side (for example, 80% of the current value of the high density side) or to a value calculated based on the toner charge amount using the following Equation 2.

$$\begin{aligned}(\text{Current Value of Allowable Density}) = {} & (\text{Toner Charge Amount}) \times \\ & (\text{Allowable Toner Adhesion Amount}) \times \\ & (\text{Total Width of Stripe Images}) \times \frac{(\text{Sampling Distance})}{(\text{Sampling Time})}\end{aligned} \quad \text{Equation 2}$$

The controller 100 functions as a toner charge amount detector, for example, by calculating toner adhesion amount based on the optical reflection density detected by the density sensor from the patch image of each of Y, M, C, and K toners formed on the intermediate transfer belt 421, and by detecting toner charge amount based on this toner adhesion amount and the developing current detected when the patch image is imaged on the photoconductor drum 413. Because the developing current is proportional to the total charge of the moving toner, the total charge of the developed toner can be obtained by measuring the developing current. The toner charge per unit mass can be calculated from the relationship between the toner adhesion amount and the total charge.

The allowable toner adhesion amount is a value determined in advance for the apparatus of the image forming apparatus 1.

The sampling distance is the length of the stripe image in the drum rotation direction. Sampling time is the time period during which the developing current is sampled.

The controller 100 determines whether or not screw unevenness has been detected for each of the Y, M, C, and K colors.

If it is determined that screw unevenness has not been detected in step S3 (step S3; NO), the controller 100 finishes the image density failure detection processing.

If it is determined that screw unevenness has been detected in step S3 (step S3; YES), the controller 100 changes imaging conditions for the toner of the color where screw unevenness has been detected (step S4).

Unless the uneven portion of the screw unevenness is completely white (no toner is developed), the effect of screw unevenness can be reduced by change of the imaging conditions and improvement of the development performance.

For example, the controller 100 increases the set value of the amplitude of the developing AC bias or increases the set value of the frequency of the developing AC bias. This increases the force to move the toner (improves the development performance), which makes it easier to develop the toner even at the uneven portions, and makes it possible to increase the density at the uneven portions. In addition, the controller 100 supplies toner to the developing device 412 to increase the toner density in the developer. This increases the amount of toner to be moved (improves the development performance), which makes it easier to develop the toner even at the uneven portions, and makes it possible to increase the density at the uneven portions. Even when the imaging conditions are changed, the density does not increase at the portion without unevenness because the toner corresponding to the latent image has already moved at such portions. The toner corresponding to the latent image has not been fully moved in the uneven portion, so the toner to be moved will be moved by the above-mentioned improvement of the development performance.

Next, the controller 100 again causes the developing current detector 90 to detect the developing current value while a stripe image for detecting screw unevenness is imaged on the photoconductor drum 413 of the image forming unit 41 of a color for which screw unevenness has been detected for confirmation, and obtains the developing current at the time when the stripe image is imaged (Step S1). The controller 100 analyzes change of the obtained developing current with time (Step S6), and determines whether or not screw unevenness has been repaired (Step S7).

In step S7, the controller 100 determines whether or not screw unevenness has been detected in the same manner as in step S3. If no screw unevenness is detected, the controller 100 determines that the screw unevenness has been repaired. If screw unevenness is detected, the controller 100 determines that the screw unevenness has not been repaired.

If it is determined that the screw unevenness has been repaired (step S7; YES), the controller 100 finishes the image density failure detection processing.

If it is determined that the screw unevenness has not been repaired (Step S7; NO), the controller 100 determines whether the developing AC bias condition is the upper limit and the toner density is the upper limit (Step S8).

In step S8, the controller 100 determines whether or not to retry the repair of the screw unevenness. The controller 100 may determine whether or not to retry the repair depending on the number of times the imaging conditions are changed, instead of the above-mentioned imaging conditions.

If it is determined that the developing AC bias condition is not the upper limit or the toner density is not the upper limit (Step S8; NO), the controller 100 returns to Step S4 and retries the repair.

If it is determined that the developing AC bias condition is the upper limit and the toner density is the upper limit (step S8; YES), the controller 100 performs error notification process (step S9) and finishes the image density failure detection processing.

In step S9, for example, the controller 100 stops the operation of the image forming apparatus 1 and causes the display 21 to display a notice that prompts the user to call a service person. Alternatively, the controller 100 may, without stopping the operation of the image forming apparatus 1, cause the display 21 to display a notification to alert the user that screw unevenness is occurring and to show the color for which the screw unevenness is occurring. Alternatively, the controller 100 may cause the above notification to be output by voice.

As explained above, the controller 100 of the image forming apparatus 1 causes a stripe image, having a width in the drum length direction that is narrower than the period of the blade of the supply screw 33 and a length in the drum rotational direction that is is longer than the period of the screw unevenness, to be imaged on the photoconductor drum 413. The controller 100 analyzes the change of the developing current with time detected by the developing current detector 90 during imaging of the stripe image, so as to detect the screw unevenness.

Therefore, it is possible to detect screw unevenness even without an image analysis mechanism.

Furthermore, the detected developing current can be increased when a plurality of stripe images imaged on the photoconductor drum 413 during detection of screw unevenness are in equal periods in the length direction of the photoconductor drum 413, and when adjacent stripe images are in a period of integral multiple of the period of the blade of the supply screw 33. This makes it easier to analyze the period of developing current and to detect screw unevenness.

The screw unevenness can be repaired by changing the imaging conditions such as the developing AC bias and the toner density of the developer according to the detection result of the screw unevenness.

In addition, by setting the detection criterion for the screw unevenness based on the detection result of the toner charge amount in the developer, it is possible to detect screw unevenness using the detection criterion according to the toner charge amount.

The description in the above embodiment is a preferred example of the invention and does not limit the present invention.

For example, the above described image forming apparatus as an example according to the embodiment is a color image forming apparatus that transfers the image formed on the photoconductor drum to the intermediate transfer belt (primary transfer) and then transfers the image on the intermediate transfer belt to a sheet using the secondary transfer roller. However, the present invention is also applicable to a monochrome image forming apparatus in which an image on the photoconductor drum is directly transferred to a sheet using a transfer roller.

In the above description, the computer-readable medium for the program according to the present invention is non-volatile memory, hard disk, etc., but the medium of the invention is not limited to this. A portable recording medium such as CD-ROM is also applicable as an example of other computer readable media. Carrier waves (carrier waves) are also applicable as a medium that provides data of the program according to the present invention via communication lines.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a developer carrier that carries developer;

a screw-shaped developer feeder that feeds developer to the developer carrier;

an image carrier on which an image is imaged with toner of the developer that is fed from the developer carrier;

a developing current detector that detects a value of developing current that flows between the image carrier and the developer carrier during imaging; and a controller that detects image density failure that is periodic and oblique to a rotation direction of the image carrier, wherein the controller causes a stripe image to be imaged on the image carrier and analyzes change of the developing current with time detected by the developing current detector during imaging of the stripe image, thereby detecting the image density failure, the stripe image having a width in a length direction of the image carrier that is narrower than a period of a blade of the developer feeder and having a length in a rotation direction of the image carrier that is longer than a period of the image density failure.

2. The image forming apparatus according to claim 1, wherein the stripe image includes a plurality of stripe images, and the controller causes the stripe images to be imaged on the image carrier, thereby detecting the image density failure, the stripe images being arranged in an equal period in the length direction of the image carrier, the equal period being an integral multiple of the period of the blade of the developer feeder.

3. The image forming apparatus according to claim 1, wherein the stripe image has a long side that crosses the image density failure having a line shape oblique to the rotation direction of the image carrier.

4. The image forming apparatus according to claim 1, wherein the controller changes an imaging condition depending on a detection result of the image density failure.

5. The image forming apparatus according to claim 4, wherein the imaging condition includes a setting value of a bias applied to the developer carrier during imaging.

6. The image forming apparatus according to claim 4, wherein the imaging condition includes a toner density of the developer.

7. The image forming apparatus according to claim 1, further comprising a toner charge amount detector that detects a charge amount of toner of the developer, wherein the controller sets a detecting criterion of the image density failure based on a detection result of toner charge amount detected by the toner charge amount detector.

8. The image forming apparatus according to claim 1, wherein, the controller determines, upon detecting of the developing current during imaging of the stripe image that changes periodically with time, upon the developing current changing periodically with time corresponding to the period of the image density failure in the rotation direction of the image carrier or corresponding to an integral multiple of the period of the image density failure, and upon the developing current changing periodically with time has a minimum value that is below a predetermined detection criterion, that the image density failure is detected.

9. A detection method of image density failure performed in an image forming apparatus that comprises a developer carrier that carries developer; a screw-shaped developer feeder that feeds developer to the developer carrier; an image carrier on which an image is imaged with toner of the developer that is fed from the developer carrier; and a developing current detector that detects a value of developing current that flows between the image carrier and the developer carrier during imaging, the image density failure being periodic and oblique to a rotation direction of the image carrier, the detection method comprising:

imaging a stripe image on the image carrier, the stripe image having a width in a length direction of the image carrier that is narrower than a period of a blade of the developer feeder and having a length in a rotation direction of the image carrier that is longer than the period of the image density failure, and analyzing change of the developing current with time detected by the developing current detector during imaging of the stripe image, thereby detecting the image density failure.

* * * * *